US005947271A

United States Patent [19]

Follman

[11] Patent Number: 5,947,271

[45] Date of Patent: Sep. 7, 1999

[54] VALISE FOR STORING DELICATE ARTICLES

[76] Inventor: Aaron Follman, 60/12 Chai Taib Street, Jerusalem 95405, Israel

[21] Appl. No.: 08/820,328

[22] Filed: Mar. 12, 1997

[30] Foreign Application Priority Data

Mar. 14, 1996 [IL] Israel ..... 117498

[51] Int. Cl.[6] ..... A45C 11/00

[52] U.S. Cl. ..... 206/19; 206/575; 206/752

[58] Field of Search ..... 206/19, 752, 232, 206/216, 575, 424, 45.2, 1.7, 751.755, 804; 220/335, 212; 248/449, 448, 447; 211/42, 43

[56] References Cited

U.S. PATENT DOCUMENTS

| | | | |
|---|---|---|---|
| 550,237 | 11/1895 | Alexander | 206/19 |
| 2,503,833 | 4/1950 | Miller | 206/804 |
| 2,533,577 | 12/1950 | Godfrey | 206/804 |
| 2,822,847 | 2/1958 | Cesaroni, Jr. . | |
| 2,934,388 | 2/1960 | Brown . | |
| 3,840,113 | 10/1974 | Bartleson | 206/575 |
| 4,573,581 | 3/1986 | Galloway et al. . | |
| 4,856,856 | 8/1989 | Winstone | 206/1.7 |
| 5,190,127 | 3/1993 | Cummings | 206/232 |
| 5,221,003 | 6/1993 | Chang | 206/216 |
| 5,462,170 | 10/1995 | Colgate | 206/232 |
| 5,582,883 | 12/1996 | Keshishian | 206/19 |

FOREIGN PATENT DOCUMENTS

| | | |
|---|---|---|
| 0157751 | 10/1985 | European Pat. Off. . |
| 0187499 | 7/1986 | European Pat. Off. . |
| 0 352 544 | 1/1990 | European Pat. Off. . |
| 2 689 734 | 10/1993 | France . |
| 525490 | 8/1940 | United Kingdom . |
| 836063 | 6/1960 | United Kingdom . |
| 1311955 | 3/1973 | United Kingdom . |

*Primary Examiner*—Paul T. Sewell
*Assistant Examiner*—Nhan T. Lam
*Attorney, Agent, or Firm*—Helfgott & Karas, P.C.

[57] ABSTRACT

This invention discloses a valise for storing delicate articles including an enclosure for storing the delicate articles, wherein the enclosure is at least partially surrounded by a layer of material of high thermal capacity and at least partially surrounded by a layer of material of high thermal resistance, wherein the layer of material of high thermal capacity is interposed between the enclosure and the layer of material of high thermal resistance.

7 Claims, 4 Drawing Sheets

0.1

VALISE FOR STORING DELICATE ARTICLES

FIELD OF THE INVENTION

The present invention relates to carrying cases in general and small valises in particular.

BACKGROUND OF THE INVENTION

Various types of insulating enclosures for storing articles are known. Vacuum flasks are a conventional device for storing fluids at temperatures independent of the environment. However, vacuum flasks are delicate devices and require an outer container as a protection against mishandling by a user. This outer container increases the weight of the device and makes it bulky and heavy for the user.

Various devices are known for storing solid articles, in a constant temperature environment but these devices are also bulky and heavy.

There is thus a requirement for a light-weight and portable apparatus for storing delicate articles in a substantially constant temperature environment independent of the outside environmental conditions, such as temperature and humidity.

SUMMARY OF THE INVENTION

The present invention seeks to provide improved apparatus for carrying delicate articles in a substantially constant temperature volume independent of the temperature and conditions of the outside environment.

There is thus provided in accordance with a preferred embodiment of the present invention a valise for storing delicate articles including an enclosure for storing the delicate articles, wherein the enclosure is at least partially surrounded by a layer of material of high thermal capacity and at least partially surrounded by a layer of material of high thermal resistance, wherein the layer of material of high thermal capacity is interposed between the enclosure and the layer of material of high thermal resistance.

Further in accordance with a preferred embodiment of the present invention the material of high thermal resistance includes polystyrene, cork and glass wool.

Still further in accordance with a preferred embodiment of the present invention the material of high thermal capacity includes aluminum.

There is also provided in accordance with a preferred embodiment of the present invention a valise for storing delicate articles wherein the valise includes a thermally insulated enclosure for storing the delicate articles, a lid, a hinge and a first supporting device including a reflective surface, wherein the lid is held in a first open position by the hinge and the lid held in a second open position by the first supporting device.

Further in accordance with a preferred embodiment of the present invention the lid includes a second supporting device located on an outer surface of the lid operative to support a reading material when the valise is in the second open position.

Still further in accordance with a preferred embodiment of the present invention the thermal insulating enclosure includes at least one wall, wherein the at least one wall is constructed of material of high thermal capacity.

Additionally in accordance with a preferred embodiment of the present invention the thermal insulating enclosure also comprises a material of high thermal resistance and wherein said material of high thermal resistance at least partially surrounds the at least one wall.

Preferably, the material of high thermal resistance includes polystyrene, glass wool and cork.

Additionally in accordance with a preferred embodiment of the present invention the material of high thermal capacity includes aluminum.

There is also in accordance with a preferred embodiment of the present invention a valise including a lid, a first support device located on an outer surface of said lid and the first support device is operative to support a reading material when said lid is in an open position.

Further in accordance with a preferred embodiment of the present invention the first support device includes a fixed ledge.

Still further in accordance with a preferred embodiment of the present invention the first support device includes a retractable ledge.

Additionally in accordance with a preferred embodiment of the present invention also including a second support device operative to support said lid in the open position, wherein the second support device includes a reflecting surface.

Moreover in accordance with a preferred embodiment of the present invention the reflecting surface faces substantially away from said outer surface of said lid.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
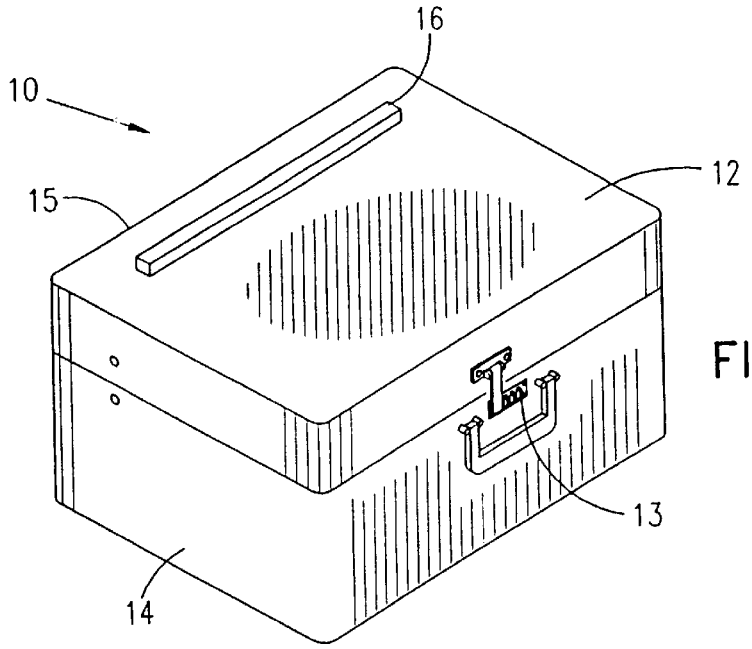
FIG. 1 illustrates a valise in a closed position, constructed and operative in accordance with a preferred embodiment of the present invention.

Reference is now made to FIG. 1 which illustrates a valise 10 constructed in accordance with a preferred embodiment of the present invention. The valise 10 comprises a lid 12, a base 14 and may also include a locking mechanism 13, such as a combination lock as is known in the art. A ledge 16 is located in proximity to an outer border 15 of lid 12. The purpose of the ledge 16 is described hereinbelow.

Figure 2:
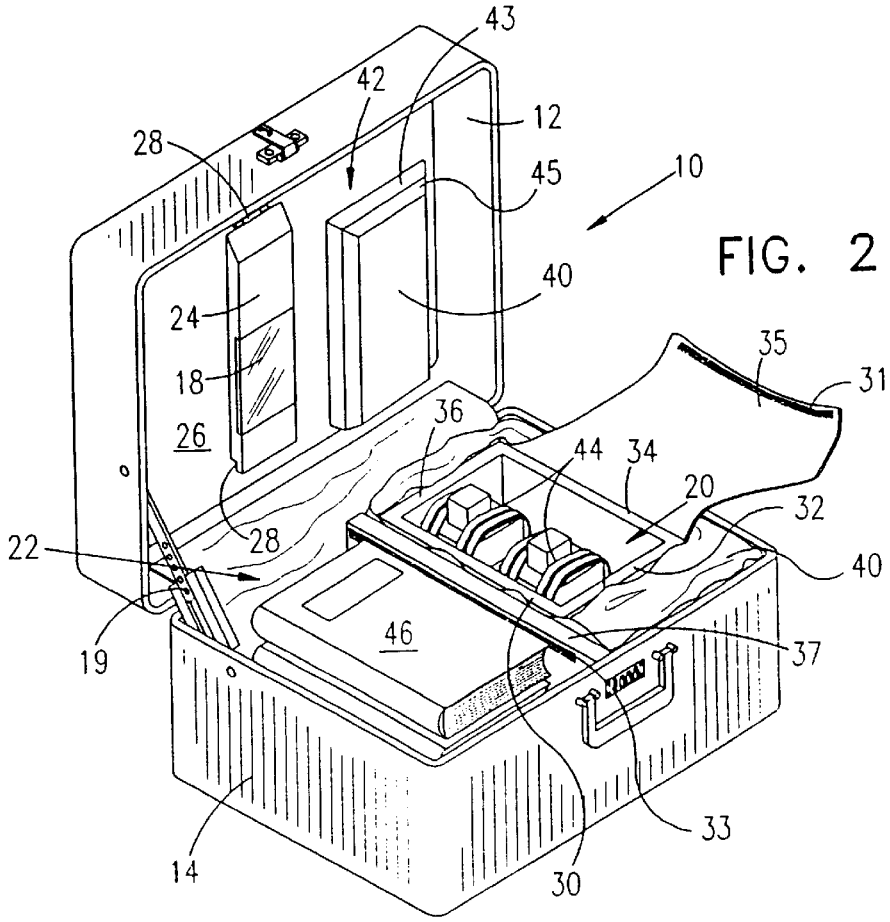
FIG. 2 illustrates a the interior of the valise of FIG. 1, when the valise is in a fully open position.

Reference is now made to FIG. 2 which illustrates the valise 10 with a lid 12 thereof open, the lid 12 being held in this open position by a hinge 19. The hinge 19 is preferably of the variable extension type, as is known in the art, allowing the lid 12 to be supported in a plurality of open positions.

The inside of the valise 10 preferably includes a support device 24, a reflecting surface 18, such as a mirror, mounted on the support device 24, an enclosure 20 and may also comprise a storage volume 22. Typically the enclosure 20 is separated from the storage volume 22 by a dividing wall 37.

As illustrated in FIG. 2, the reflecting surface 18 is generally in an orientation facing the outside of the valise 10. Alternatively, the reflecting surface 18 may be in any other orientation.

The support device 24 is pivotally connected to an inside surface 26 of the lid 12, by a pivot 28. For storage purposes a securing device (not shown) may be attached to the support device 24 to prevent the support device 24 swinging freely about the pivot 28. Such a securing device may include at least one piece of Velcro brand fastening strip attached to a back surface (not shown) of support 24 and at least one piece of Velcro brand fastening strip attached to the inside surface 26.

The support device 24 preferably includes a lip 28 cut at an edge thereof. The purpose of lip 28 is described hereinbelow with respect to FIG. 3.

The enclosure 20, located in the base 14 of valise 10, is surrounded by walls 30, 32, 34 and 36. The walls 30, 32, 34 and 36 are preferably constructed of a material of high thermal capacity, such as aluminum or any other suitable material. A thermal insulating layer 40, of high thermal resistance, surrounds the walls 30, 32 34 and 36, as illustrated in FIG. 2.

A cover 42 is preferably mounted on the surface 26 comprising a thermal insulating layer 43, of similar material to the insulating layer 40, and a high thermal capacity material 45, such as aluminum. The cover 42 fits into the top area of the enclosure 20 and provides a sealing lid to the enclosure 20 when the lid 12 of the valise 10 is closed as in FIG. 1.

The enclosure 20 also includes a base surface (not shown) mounted on the base 14. The base of the enclosure 20 comprises an insulating layer mounted on the base 14 and a layer of material, such as aluminum, attached to the insulating layer in a similar configuration to the layer 45 of the cover 42.

Typical thermal insulating materials, of high thermal resistance, are polystyrene, cork and glass wool. However, any other suitable thermally insulating material may be used.

The combination of a material of high thermal capacity and a material of high thermal resistance maintains the temperature of the enclosure 20 substantially independent of the temperature of the outside environment. Thus the enclosure 20 becomes a substantially temperature independent storage volume for storing delicate articles which are sensitive to the outside temperature.

When the valise is opened and a delicate article is placed in the enclosure 20, the inside walls 30, 32, 34, and 36 of the enclosure 20 acquire the temperature of the surroundings, such as the local room temperature. On closing the lid 12 of the valise 10, the enclosure 20 is sealed from the outside environment and the initial temperature of the inside enclosure 20 is substantially maintained by the thermal insulating material 40. Thus, the physical conditions of the sealed enclosure 20, such as the temperature and humidity, are substantially independent of changes in the environmental conditions outside the valise 10.

Typical delicate articles, for storing in enclosure 20, may be religious articles, such as a pair of phylacteries 44.

Additionally, a resilient material (not shown), such as a sponge type material, may be fixed to the thermal insulator 40 and to the insulating layer (not shown) of the base of the valise in order to provide a soft and secure lid and base, respectfully, for the delicate articles in the enclosure 20.

Additionally, the valise 10 may also comprise a storage volume 22. This volume 22 may be used for storing articles which are relatively insensitive to the temperature and humidity of the environment, such as a book 46 and a prayer shawl (not shown). The storage volume 22 is separated from the enclosure 20 by the wall 37, which may be made of material typically the same as the material of the base 14.

Furthermore, preferably attached to an inside edge of the wall 14 is a cover 35, typically made of a cloth material such as velvet, for covering the delicate articles 44 stored in the enclosure 20. The delicate articles in enclosure 20 may be covered by pulling the cover 35 over the enclosure 20 and fixing to the wall 37 by a securing device, such as two lengths of Velcro brand fastening strip, 31 and 33. Thus, on opening the valise 10 a user only views the contents of volume 22; the articles, such as the pair of phylacteries 44, are hidden from immediate view by the cover 3 5.

Figure 3:
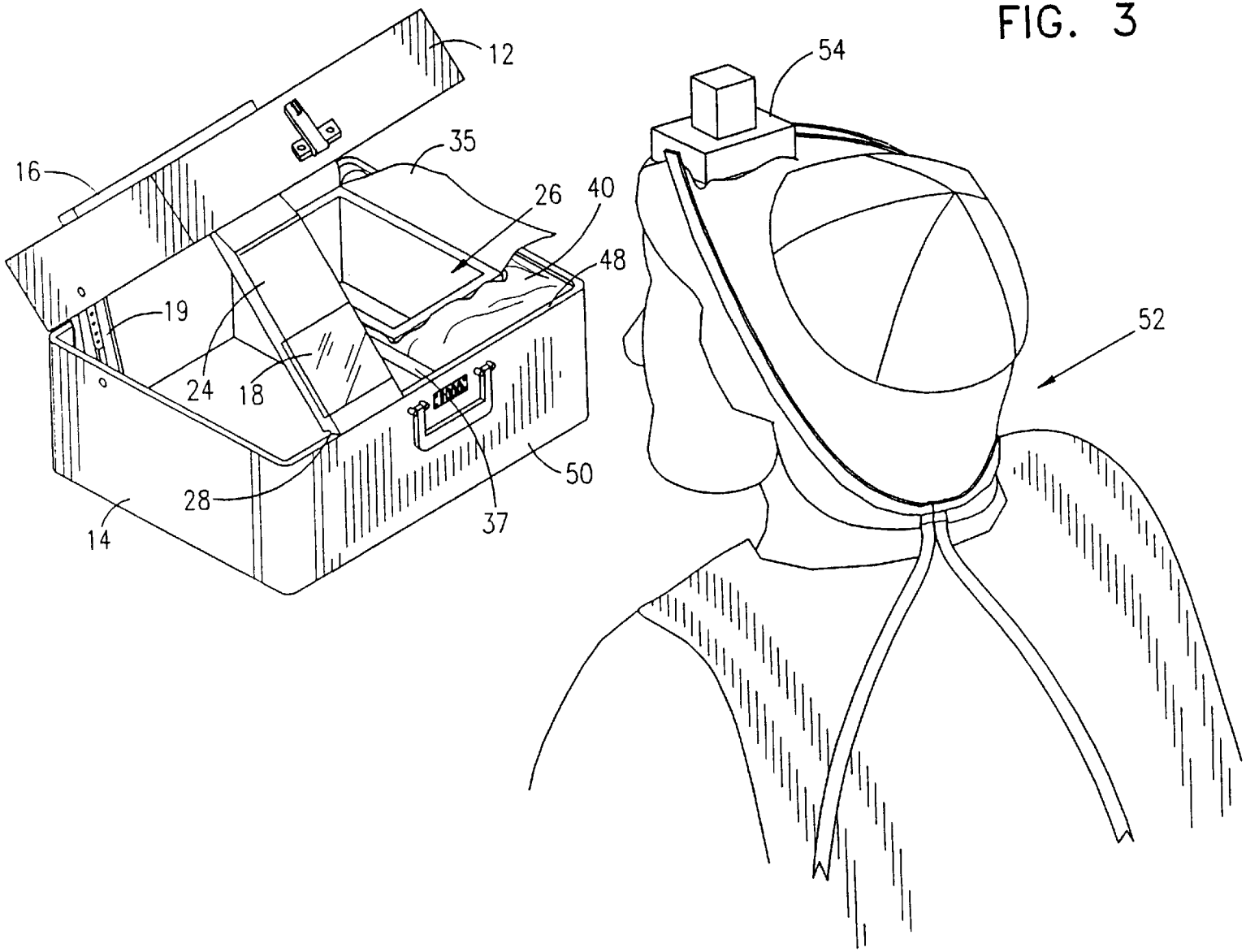
FIG. 3 illustrates the valise of FIG. 1, in a partially open position, showing a person adjusting a head phylactery by viewing a reflecting surface attached to a supporting

Reference is now made to FIG. 3 which illustrates the valise 10 in an open position in which the lid 12 is partially open and held in this position by the lip 28 of support device 24 resting on an edge 48 of a vertical wall 50 of the base 14.

FIG. 3 further demonstrates a typical use of valise 10 in the present partially open position, in which the reflecting surface 18 is used by a user 52 for checking the location of a head phylactery 54.

By means of the variable extension hinge 19, the lid 12 may be held in a plurality of open positions without the supporting mechanism 24 resting on the edge 28. This also allows the user 52 to check the location of the head phylactery 54 at the plurality of lid open positions by manually holding the support device 24 to the required angle for viewing the head phylactery 54 in the reflecting surface 18.

Figure 4:
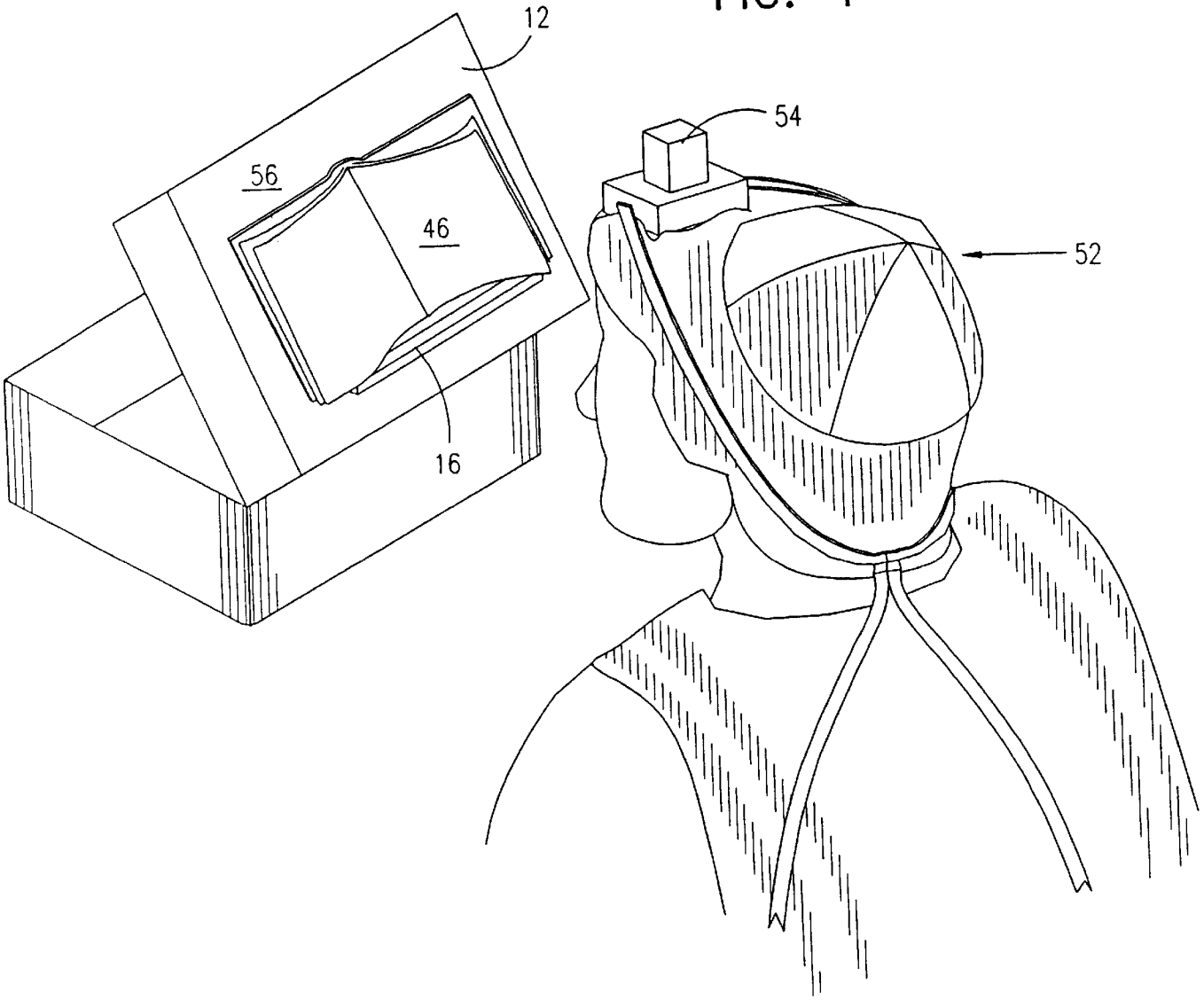
FIG. 4 illustrates the valise of FIG. 1, in an open position, showing a use of the outside surface of the valise, operative in accordance with a preferred embodiment of the present invention.

Reference is now made to FIG. 4 which demonstrates another typical use of the open valise 10. The open valise 10 has been rotated, relative to the user 52, so that an outer surface 56 of the lid 12 is facing generally towards user 52. In this position, the user 52 places a reading material, such as the book 46, on the surface 56, The book 46 is held in position by resting on the ledge 16.

FIG. 4 demonstrates a use of valise 10 by the user 52, who in this case, is praying, with the valise 10 supporting the book 46, which may be a prayer book. In this embodiment the ledge 16 is typically fixed to the lid 12.

Figure 5A:
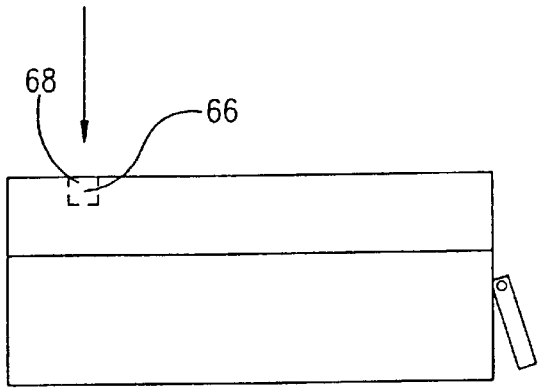
FIGS. 5A and 5B illustrate the valise of FIG. 1, showing a retractable ledge in an inserted position and in a released position, respectfully.
Figure 5B:
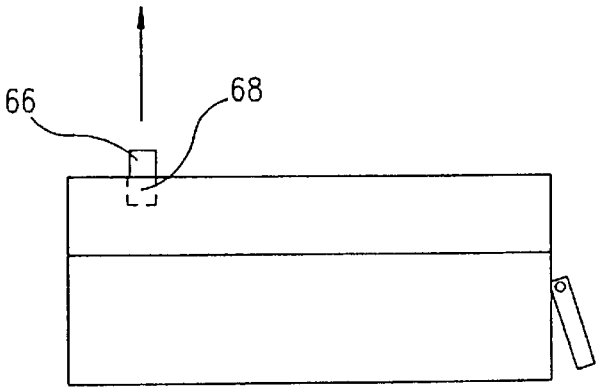

Reference is now made to FIGS. 5A and 5B which illustrate an alternative embodiment of the valise 10. In this embodiment, the valise 10 preferably includes a retractable ledge 66 assembly which replaces the fixed ledge 16 of the previous embodiment.

The ledge assembly 66 preferably comprises at least one biasing device (not shown), wherein the at least one biasing device includes a conventional spring and catch mechanism (not shown), for releasing the ledge 66 from a retracted storage position, FIG. 5A, to an open position, as illustrated in FIG. 5B. The biasing device may be located generally in the middle of the ledge 66. Alternatively or additionally, at least one biasing device may be located generally in proximity to a first end 70 of the retractable ledge 66 and a second biasing device may be located generally in proximity to a second end 72 of the retractable ledge 66. The retractable ledge 66 may be stored in a recess 68 when not in use.

Figure 5C:
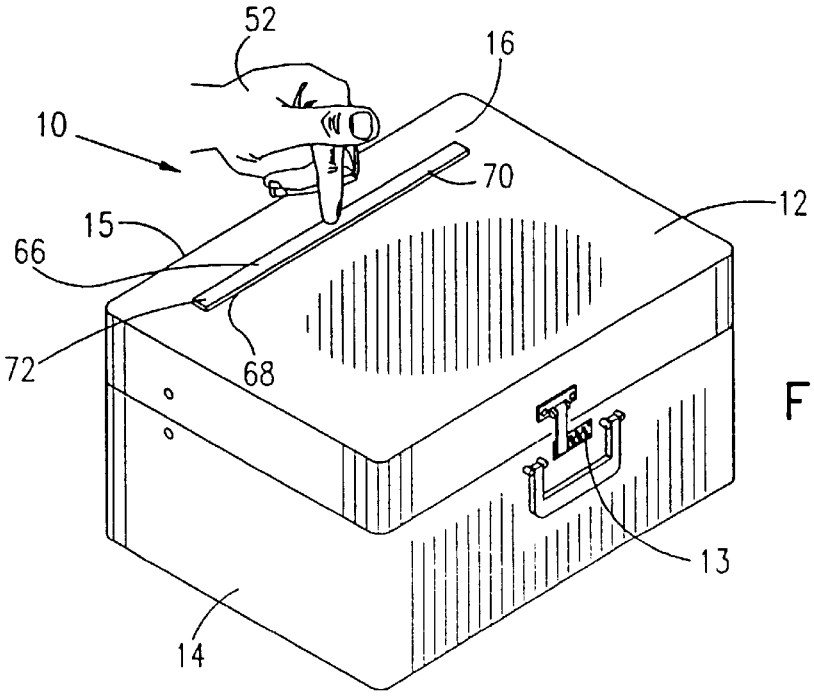
FIG. 5C illustrates the valise of FIG. 1, showing a user releasing the retractable ledge from the retracted position by pressing on the ledge.

In order to release the ledge 66 from its storage position, the user 52 presses on the ledge 66 at the appropriate position on the ledge 66, as illustrated, for example in FIG. 5C. If the user 52 continues to push the ledge 66 into the recess 68, the biasing mechanism is released and the ledge 66 recoils to a released position, as shown in FIG. 5B. However, if the user 52, on pressing the ledge 66 into the recess 68, interrupts his pressing action prior to the release of the biasing mechanism, the ledge 66 remains within the recess 68, as shown in FIG. 5A. Thus, the ledge assembly 66, when not in use, can be stowed away in recess 68, allowing for easy storage and carrying of the valise 10.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

I claim:

1. A valise comprising:

a base;

a lid;

a hinge pivotally attached to said lid and said base, said hinge capable of holding said lid in a first open position;

a thermally insulated enclosure disposed on said base;

a first supporting device pivotally connected to an inside surface of said lid, said first supporting device including a reflective surface mounted thereon, wherein said lid may be held in a second open position by said first supporting device, and a second supporting device located on an outer surface of said lid operative to support a reading material when said lid is in said second open position.

2. Apparatus according to claim 1 wherein said thermal insulating enclosure comprises:

at least one wall;

wherein the at least one wall is constructed of material of high thermal capacity.

3. Apparatus according to claim 2 wherein said thermal insulating enclosure also comprises a material of high thermal resistance and wherein said material of high thermal resistance at least partially surrounds the at least one wall.

4. Apparatus according to claim 2 wherein said material of high thermal resistance includes polystyrene.

5. Apparatus according to claim 2 wherein said material of high thermal resistance includes glass wool.

6. Apparatus according to claim 2 wherein said material of high thermal resistance includes cork.

7. Apparatus according to claim 2 wherein said material of high thermal capacity includes aluminum.

* * * * *